US012364353B2

(12) United States Patent
Jenkins

(10) Patent No.: US 12,364,353 B2
(45) Date of Patent: Jul. 22, 2025

(54) PORTABLE FABRIC LENGTH ENHANCEMENT SYSTEM AND METHOD OF USE

(71) Applicant: William Jenkins, Manassas, VA (US)

(72) Inventor: William Jenkins, Manassas, VA (US)

( * ) Notice: Subject to any disclaimer, the term of this patent is extended or adjusted under 35 U.S.C. 154(b) by 45 days.

(21) Appl. No.: 18/140,680

(22) Filed: Apr. 28, 2023

(65) Prior Publication Data

US 2023/0414023 A1 Dec. 28, 2023

Related U.S. Application Data

(60) Provisional application No. 63/473,072, filed on Apr. 29, 2022.

(51) Int. Cl.
*A47G 25/66* (2006.01)
*D06C 3/08* (2006.01)

(52) U.S. Cl.
CPC ..... *A47G 25/66* (2013.01); *D06C 3/08* (2013.01)

(58) Field of Classification Search
CPC ..... A47G 25/66; A47G 25/68; D06C 3/08; D06C 3/00; D06F 71/18; D06F 71/28; D06F 71/29
See application file for complete search history.

(56) References Cited

U.S. PATENT DOCUMENTS 283,994 A 8/1883 French
418,015 A * 12/1889 Hall ..... D06C 3/00 38/102.4
830,429 A 9/1906 Hall
903,602 A * 11/1908 Mitchell ..... D06C 3/00 38/102.4
948,895 A * 2/1910 Lane ..... D06C 3/00 38/102.4
1,330,356 A * 2/1920 Starr ..... A47G 25/68 38/102.4
1,793,219 A 2/1931 Freidberg
1,866,553 A * 7/1932 Eskandarian ..... D06F 73/00 38/144
2,170,126 A 9/1936 Cleophas
2,517,331 A * 8/1950 Mccauley ..... D06F 71/40 38/108
2,521,889 A 9/1950 Yustin
(Continued)

FOREIGN PATENT DOCUMENTS

DE 19938013 A1 8/1999
FR 322639 A 6/1902
(Continued)

*Primary Examiner* — Ismael Izaguirre
(74) *Attorney, Agent, or Firm* — Jonathan Brown

(57) ABSTRACT

An article of clothing is provided and placed between a pair of clamps, each comprised of a respective pairs of member sets. The article is placed on the respective bottom members of the clamps. The upper and lower ends of a pair of spreader mechanisms are secured to the clamps. If reversible clamp member securing mechanisms are present, the respective upper and lower clamps are closed via a member holding mechanism and member clamp securing mechanisms, or member multiple member holding mechanisms. The clamps are secured, and the spreader activation mechanism of each spreader mechanism is activated, thereby placing an expansive force on the article of clothing.

19 Claims, 11 Drawing Sheets

(56) References Cited

U.S. PATENT DOCUMENTS

| | | | |
|---|---|---|---|
| 4,858,349 | A | 8/1989 | Walsh et al. |
| 6,324,776 | B1 | 12/2001 | Miyata |
| 6,834,783 | B2 | 12/2004 | Kimura |
| 7,226,046 | B2 | 6/2007 | Kloepfer et al. |
| 9,156,138 | B1 | 10/2015 | Prescott |
| 9,751,193 | B2 | 9/2017 | Evatt et al. |

FOREIGN PATENT DOCUMENTS

| | | | |
|---|---|---|---|
| FR | 604926 | A | 10/1925 |
| GB | 183046 | A | 7/1921 |
| GB | 184693 | A | 8/1921 |
| GB | 201370 | A | 6/1922 |
| GB | 336835 | A | 11/1929 |
| WO | WO200127379 | A1 | 10/1999 |

* cited by examiner

PORTABLE FABRIC LENGTH ENHANCEMENT SYSTEM AND METHOD OF USE

CROSS REFERENCE TO RELATED APPLICATION(S)

This non-provisional application claims the benefit of, U.S. Provisional Application No. 63/473,072 entitled "MECHANICAL FABRIC SPREADER/LENGTHENER/STRETCHER," filed on Apr. 29, 2022.

The subject matter of this application is hereby incorporated by reference in its entirety.

TECHNICAL FIELD OF THE INVENTION

The present invention relates to the general field of clothing and fabrics, and specifically to systems for enhancing the useful lifetime of clothing and fabrics.

BACKGROUND

It is no secret that clothing is among an individual or family's greater expenses. The typical US household currently spends about $120 per month on clothing, which works out to over $1,400 per year. A pair of simple denim jeans typically cost over $50 and up to $100 or more. Shirts or blouses can also easily cost $100 or more.

The reason that clothing is often discarded isn't that the clothing is torn or worn out, but because children regularly outgrow their clothing. With the rapid growth of children, it is common for parents to have to buy clothing for their children, only for the children to outgrow this clothing. As children grow taller, the legs and sleeves can become too short and sometimes the torso as well. This tends to be particularly true of the sleeves and pant legs—within a year; and often within six months. It is common for parents to but their children new clothes, at high cost, just before the school year begins in fall, only to have their children's clothes not even last through school year. The parents are forced to give away or discard this clothing that is otherwise in good condition and pay to replace it.

Further, clothing can often shrink, affecting both adults and children. As clothing is repeatedly washed and dried, this process can often result in the shrinkage of clothing. This is particularly true of clothing that is washed in hot water, or dried with heated drying. As clothing shrinks, it often does so primarily in the sleeves or legs, making a wearer's arms and legs now too long to fit. The wearer then often has to give away or discard the clothing, and money has to be spent to replace otherwise good clothing.

In addition, there are a number of wearers with sleeves and legs that are longer—typically by an inch or two, but can be even longer—than within the range of standard sizes. For example, wearers often are an inch or two longer in the legs than standard waist widths for pants, or have arms that are an inch or two longer. Longer arms can be particularly troublesome because shirts and blouses, such as business shirts, often come in a set of standardized sizes, wherein the sleeve length is related to the overall size of the shirt. This can often leave a shirt or blouse wearer with longer arms with a choice to either accept too-short sleeves or buy a shirt or blouse that is too long.

Currently, devices capable of stretching fabric, generally and on an industrial scale, are known in the art. However, such devices tend to be large, bulky and not designed, or able to, stretch individual articles of clothing. There are also devices known in the art for increasing hat bands or stretching pant waists. However, these are designed to increase openings rather than enhancing length, and not designed for the clothing types, and do not address the issues, herein.

Accordingly, many clothing wearers have a thus-far unmet need to extend the life of their own and their children's clothes. Because much shrinkage or outgrowing occurs in the sleeves and legs, as pant legs and sleeves shrink, or arms and legs grow, the ability to ameliorate this could greatly increase the useful life of clothing.

SUMMARY

A comprehensive system for spreading fabric and lengthening the life of clothes is shown and described herein.

A fabric stretching system is disclosed. The system is generally comprised of a set of clamps, member holding mechanisms, and at least a pair of stretching spreaders.

The clamp set is comprised of at least one set of clamps and in one embodiment, a pair of clamps. An upper clamp is comprised of an upper top clamp member and an upper bottom clamp member. The lower clamp is comprised of a lower top clamp member and lower bottom clamp member. Each respective sets of clamp members are reversibly secured to each other by at least one member holding mechanism.

In some embodiments, each respective pair of clamp members are secured by at least a single member holding mechanism.

The at least a pair of stretching spreaders is comprised of a pair of fabric stretching spreaders. The fabric spreaders are each comprised, generally, of a rod and a spreader activation mechanism connected to, and working with, the rod.

The spreaders are secured at an upper end by upper member slots within at least one member set. In an embodiment, a pair of slots are placed within the upper top member. A pair of spreader securing mechanisms are placed, respectively at the upper end of each of the rods. The spreader securing mechanisms can be of any configuration or apparatus suitable for securing the spreaders. For example, these can include hook-shaped protrusions perpendicular from the rods, a spring device, or a member situated perpendicular from the rod. In some embodiments, at least one of the lower clamp members are provided with at least a pair of rod slots capable fitting one end of the respective rods into them.

Each of the at least pair of spreaders are capable of pulling an object along a tightening rod to push or pull the object along each rod to either stretch it out, or push it together. The spreader is operated by at least one spreader activation mechanism, which can be clamp or spreader activation apparatus as known and understood in the art.

The spreader activation mechanism can be comprised of any apparatus suitable for activating a spreading motion along the respective rods. These can include a handle and trigger and ratcheting mechanism, as in one embodiment, or other mechanisms in the art capable of performing this task.

The clamp set, in a preferred embodiment, is comprised of at least a set of upper clamp members and a set of lower clamp members. In a preferred embodiment, the clamp set is comprised of a set of upper clamp members comprised of an upper top clamp member and upper bottom clamp member; and a set of lower members comprised of a lower top clamp member and lower bottom clamp member. The respective pair of upper pair of clamp members and lower clamp members are each capable of securing an article of fabric by pressing the article between each respective pair of members of the clamp set.

For clarity, the upper and lower respective pairs of members are respectively attached to each other and located on opposite sides to each other. The top and bottom member pairs are located with each top clamp member directly above the respective lower clamp member.

The spreaders in a preferred embodiment are shown with rods spreader activation mechanisms, in this embodiment in the form of a pair of tightening trigger mechanisms as known and understood within the clamping and spreader art, and spreader upper securing mechanisms. In a preferred embodiment, the upper securing mechanisms are a pair of respective screws secured by nuts, but can be comprised of any apparatus known in the art and capable of performing this task.

In a preferred embodiment, at least one end of each respective rods of the stretching spreaders are secured to at least one set of clamp members. In this embodiment, the spreader upper securing mechanism is provided at or near the end of each respective rod, and placed through each respective rod, in a perpendicular configuration relative to the rods.

In a preferred embodiment, at least one top clamp member and bottom clamp member are secured together on one end by a mechanism, attached to one of both members for flexibly and reversibly securing the two clamp members together. In an embodiment, the top clamp member and bottom clamp member are secured to each other by a hinge on one side of the members. A bottom member can be laid flat and the top member swung, using the hinge, until the two members are together.

In a preferred embodiment, the reversible clamp member securing mechanism is attached to both members. The members are placed together, then pressed together by at least one Member holding mechanism. The member holding mechanism provided to reversibly press the top and bottom clamp members to each other. In a preferred embodiment, a single member holding mechanism is placed opposite the side of exact hinge.

The member holding mechanisms can be comprised of any suitable apparatus in the art capable of conveniently securing and releasing the clamp members to each other, including, e.g., a screw and wing nut arrangement, a screw with turnable handle, or hydraulic or electrical system, or a swing bolt arrangement. By this method, the clamp members are squeezed closer to each other via the member holding mechanism.

Once the clamps and by extension, the article of clothing, are secured, the spreader activation mechanism of each spreader mechanism is activated, thereby placing an expansive force on the article of clothing.

It is to be understood that while certain forms of the present invention have been illustrated and described herein, the expression of these individual embodiments is for illustrative purposes and should not be seen as a limitation upon the scope of the invention. It is to be further understood that the invention is not to be limited to the specific forms or arrangements of parts described and shown.

DETAILED DESCRIPTION OF PREFERRED EMBODIMENTS

Shown and described herein is a comprehensive and fabric stretching system, as well as a method of manufacture and assembly and method of use. The system 10 herein provides a way for a single person to easily stretch pieces of specific fabric, such as shirts and pants.

Figure 1:
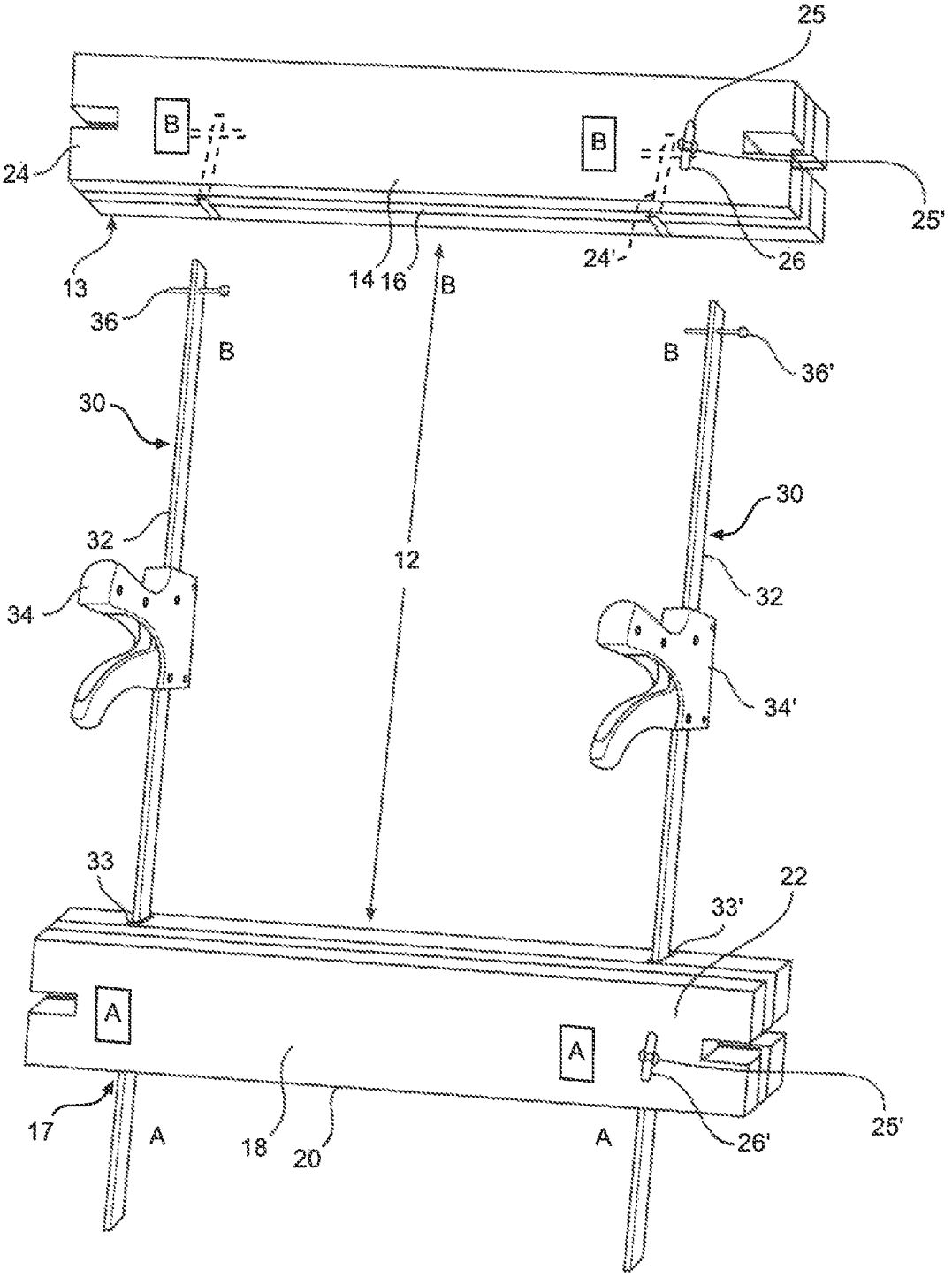
FIG. 1 is a schematic top plan diagram of an embodiment of the invention in a partially assembled configuration.

Turning to FIG. 1, an embodiment of the fabric stretching system 10 is disclosed. The system 10 is generally comprised of a set of clamps 12, member holding mechanisms 22-22", and at least a pair of stretching spreaders 30-30'.

The clamp set 12 is comprised of at least one set of clamps and in this embodiment, a pair of clamps. An upper clamp is comprised of an upper top clamp member 14 and an upper bottom clamp member 16. The lower clamp 17 is comprised of a lower top clamp member 18 and lower bottom clamp member 20. As shown in the figure, each of these respective sets of clamp members are reversibly secured to each other by at least one member holding mechanism 22. Each clamp member 14, 16 and 18, 20 is comprised of any suitable material in the art, including wood, a metal, alloy, or a plastic or resin.

Each respective member can be of any suitable size for the task, and in this embodiment, each is approximately 14" long by 2" wide by 1½" thick/

In this embodiment, each respective pair 14-16, 18-20, are secured by at least a single member holding mechanism 22, 22'. The member holding mechanism 22 can be comprised of any means known in the art for reversibly tightening, including ratchets, levers, a hydraulic or electrical system, a screw and easily turnable nut such as a wing nut, or a screw with turnable handle. In this embodiment, screws 25, 25' with wing nuts 26, 26 are shown.

The at least a pair of stretching spreaders is comprised of a pair of fabric stretching spreaders 30-30'. The fabric spreaders 30, 30' are each comprised, generally, of a rod 32, 32' and a spreader activation mechanism 34,34' connected to, and working with, the rod 32, 32'. The spreaders 32, 32' can be of any suitable size, and the spreader components can be made of any known suitable materials in the art, including a plastic or resin, metal, or a combination of these. The rods 32, 32' are comprised of metal rods approximately ½" wide, by 3/16", by 18" long.

The spreaders 30, 30' are secured at an upper end by upper member slots 24, 24' within at least one member set 14, 16.

In this embodiment, a pair of slots 24, 24' are placed within the upper top member 14. A pair of spreader securing mechanisms 36, 36' are placed, respectively at the upper end of each of the rods 32, 32'. The spreader securing mechanisms 36, 36' can be of any configuration or apparatus suitable for securing the spreaders 30, 30'. For example, these can include hook-shaped protrusions perpendicular from the rods 32, 32', a spring device, or a member situated perpendicular from the rod. In this embodiment, the spreader securing device 36, 36' are each a member perpendicular to the rods 32, 32'. The holding mechanism slots 24, 24' are shaped to accommodate and secure an end of the rods 32, 32' and spreader securing device 36, 36'.

In some embodiments, at least one of the lower clamp members 18-20 are provided with at least a pair of rod slots 33, 33' capable fitting one end of the respective rods 32, 32' into them.

Figure 2:
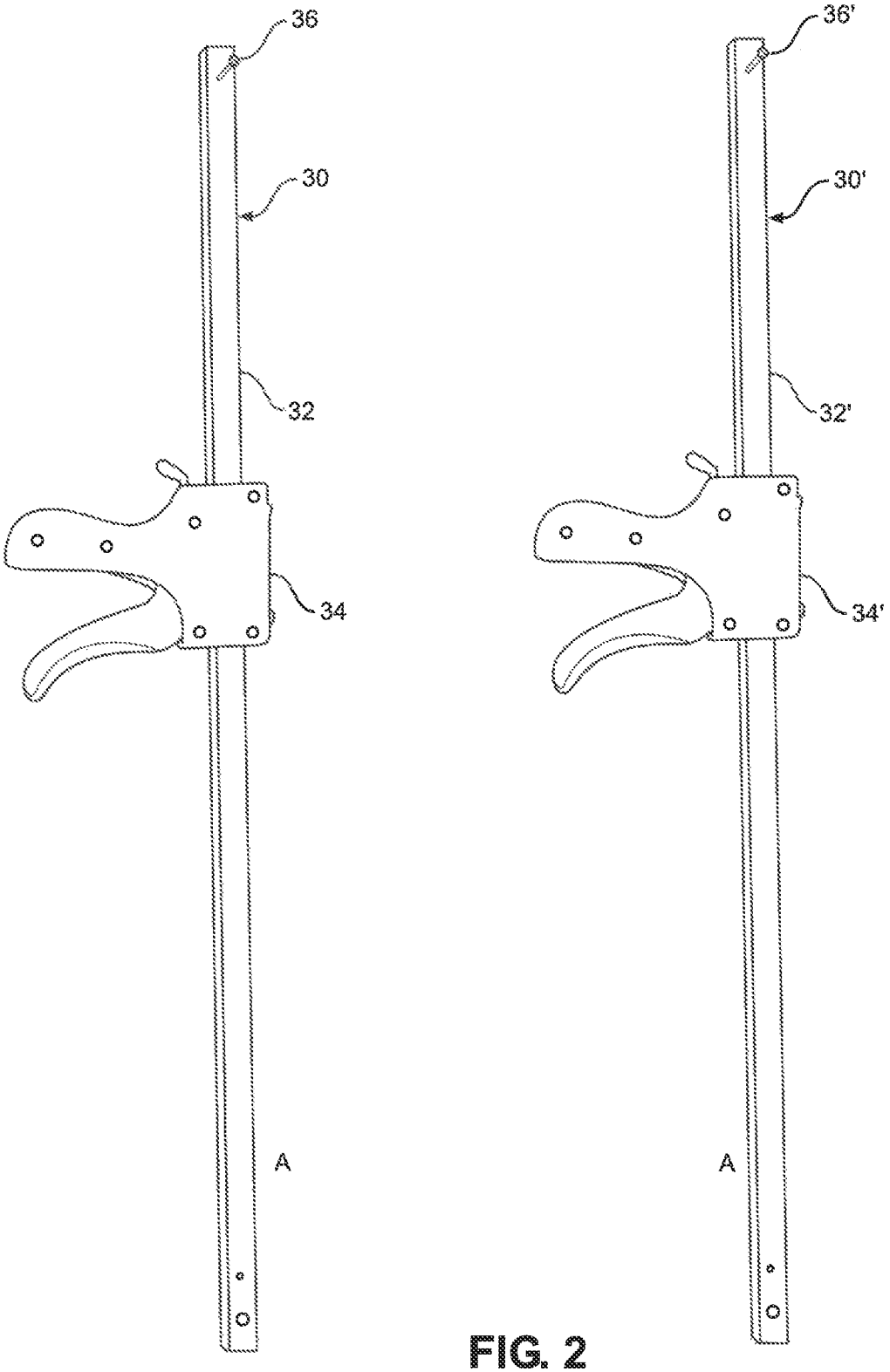
FIG. 2 is a schematic top plan diagram of some primary components of the embodiment of FIG. 1.

Turning briefly to FIG. 2, the at least a pair of spreaders 30, 30' are shown in further detail.

Each of the at least pair of spreaders 30, 30' are spreaders as known in the art, and capable of puling an object along a tightening rod 32, 32', to push or pull the object along each rod 32, 32' to either stretch it out, or push it together. The spreader is operated by at least one spreader activation mechanism 34, 34', which can be clamp or spreader activation apparatus as known and understood in the art. These spreaders are similar to wood clamping and spreading mechanisms known in the art.

The spreader activation mechanism 34, 34' can be comprised of any apparatus suitable for activating a spreading motion along the respective rods 32, 32'. These can include a handle and trigger and ratcheting mechanism, as in this embodiment, or other mechanisms in the art capable of performing this task. These can also include, e.g. turnable handles, or other ratcheting arrangement, a push button or switch or signal apparatus, attached to a motor or hydraulic or electric motor and system.

Figure 3:
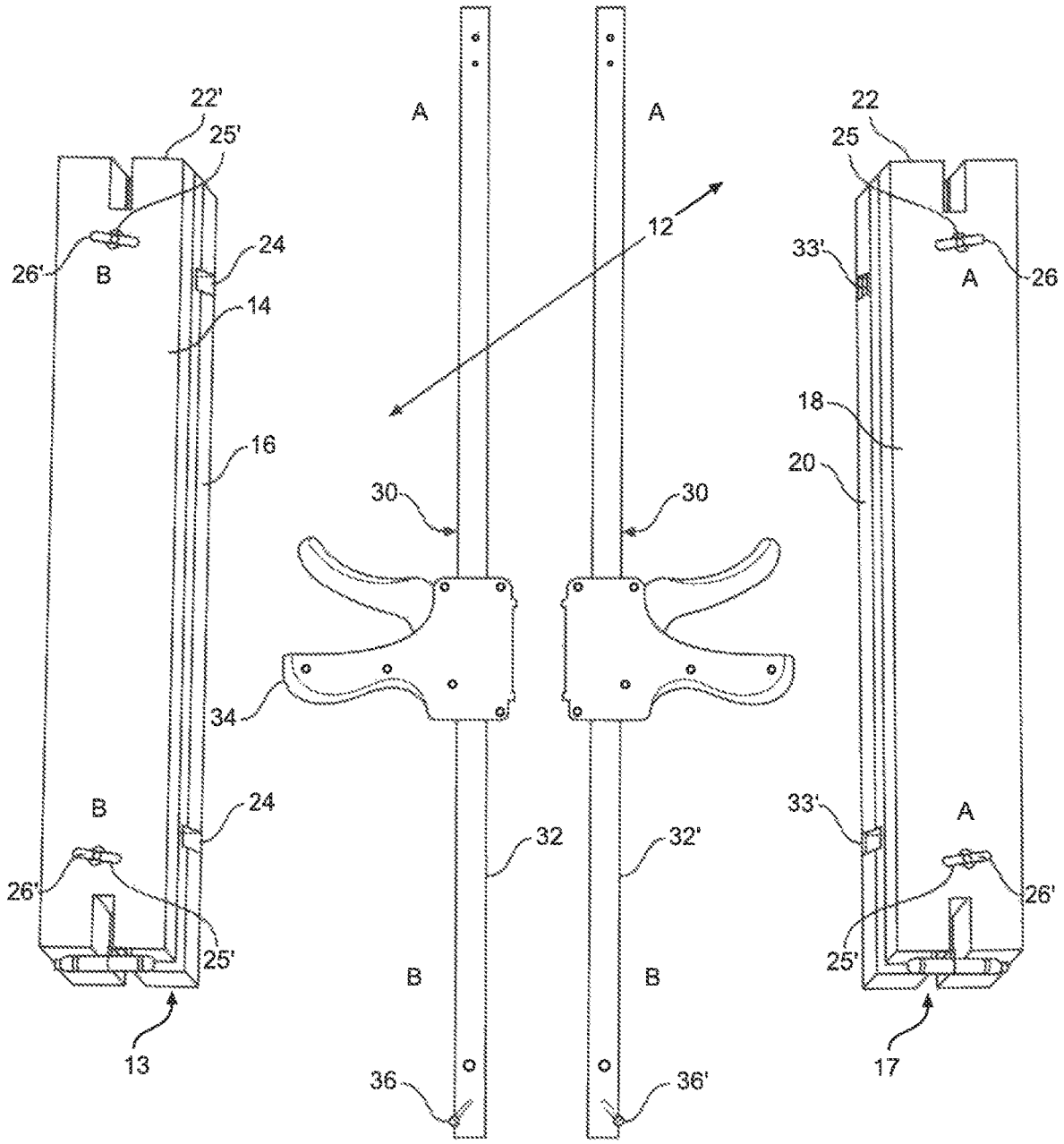
FIG. 3 is a schematic top plan diagram of some primary components of the embodiment of FIG. 1.

Turning to FIG. 3, the at least a pair of spreaders 30, 30', and clamp set 12 are shown in more specific detail. The clamp set 12, comprised of at least a set of upper clamp members 14, 16, and a set of lower clamp members 18, 20 are shown. In this embodiment, the clamp set 12 is comprised of a set of upper clamp members comprised of an upper top clamp member 14 and upper bottom clamp member 16; and a set of lower members comprised of a lower top clamp member 18 and lower bottom clamp member 20. The respective pair of upper pair of clamp members 14, 16 and lower clamp members 18, 20 are each capable of securing an article of fabric by pressing the article between each respective pair of members 14, 16; 18, 20 members of the clamp set 12.

For clarity, the upper and lower respective pairs of members 14-16 and 18-20 are respectively attached to each other and located on opposite sides to each other. The top and bottom member pairs (14 and 16, and 18 and 20) are located with each top clamp member directly above the respective lower clamp member.

The spreaders 30, 30' in this embodiment are shown with rods 32, 32', spreader activation mechanisms 34, 34' in this embodiment in the form of a pair of tightening trigger mechanisms known as known and understood within the clamping and spreader art, and spreader upper securing mechanisms 36, 36'. In this embodiment, the upper securing mechanisms 36, 36' are a pair of respective screws secured by nuts, but can be comprised of any apparatus known in the art and capable of performing this task, such as attached screws, attached rods, or rods that are part of the spreader rods 32, 32' as a one-piece construction.

Figure 4:
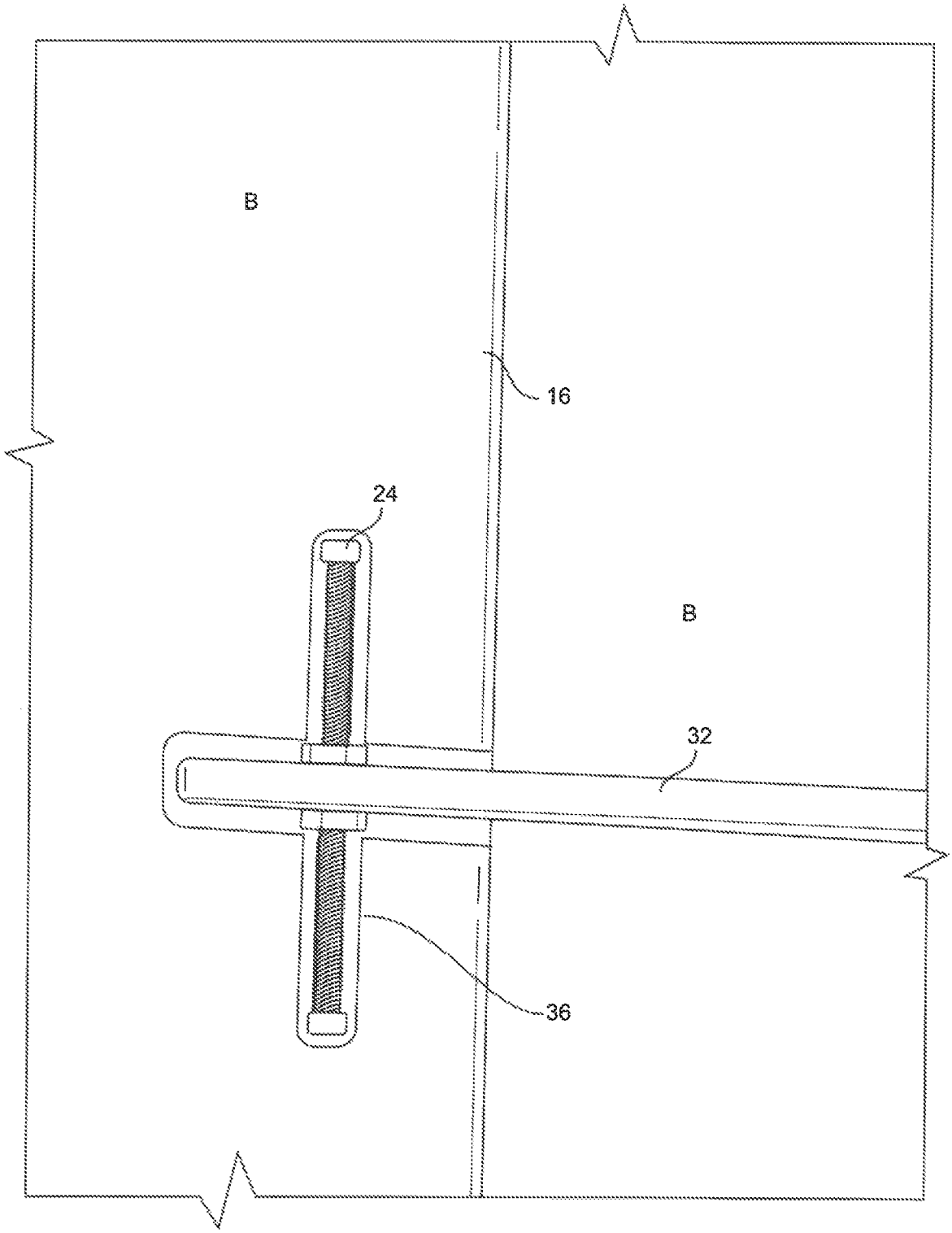
FIG. 4 is a schematic top plan diagram of a portion of the embodiment of FIG. 1.

Turning to FIGS. 1 and 4, at least one end of each respective rod 32, 32' of the stretching spreaders 30, 30' are secured to at least one set of clamp members 14-16, 16-20. In this embodiment, the spreader upper securing mechanism 36, 36' is provided at or near the end of each respective rod, rod 32, 32', and placed through each respective rod 38, 30'. In a perpendicular configuration relative to the rods 32, 32'.

A pair of respective clamp member slots or apertures 24, 24' (one of which is shown in detail in FIG. 4) are provided in any suitable location within any clamp member, and in this embodiment the clamp member slots or apertures 24, 24' are placed within the upper top clamp member 14. They can be placed at any suitable distance apart from each other, and in this embodiment, are about 1 foot apart.

Turning specifically to FIG. 4, an end of a rod 30 is shown secured. An upper securing mechanism 36 is attached at or near an end of the rod 30, and that end of the rod 30, and accompanying securing mechanism 36, is placed within the clamp member slot or apertures 24, where the slot or aperture 24 holds the end in place. The clamp member slot or aperture 24 can be placed in any suitable location in either clamp member, and in this embodiment, the aperture 24 and secured end of the rod 30 are at one end of the upper top clamp member 14.

Figure 5:
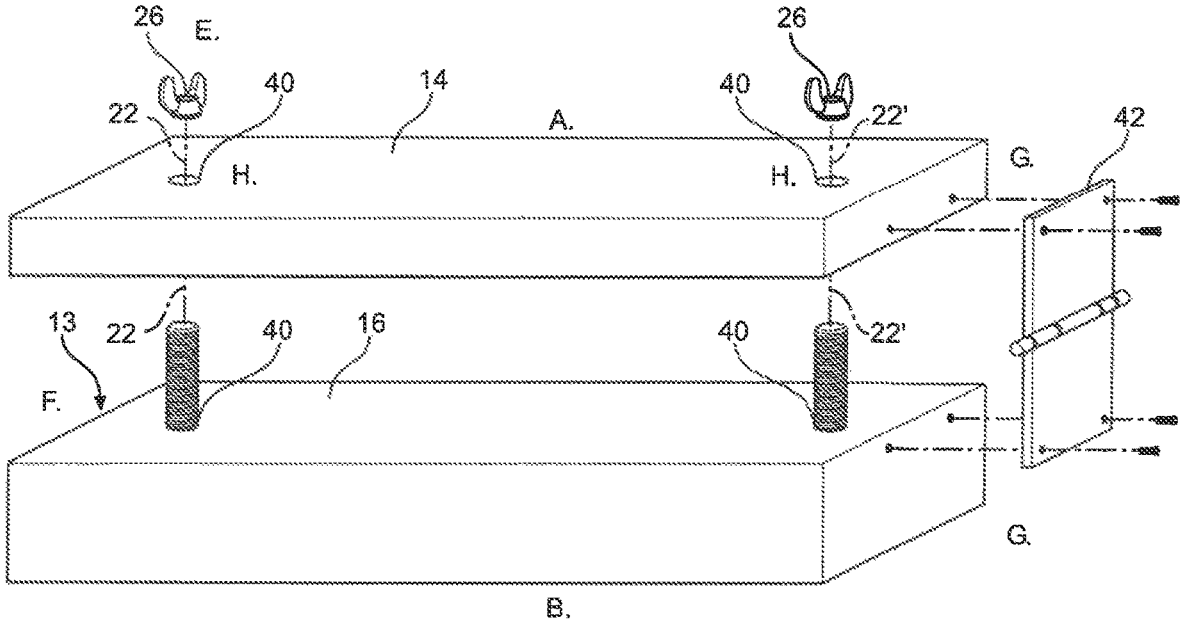
FIG. 5 is a perspective view of a portion of the embodiment of FIG. 1

Turning to FIG. 5, securing of a representative upper pair of clamp members 14, 16 and pressing the members to each other is shown. The apparatus and steps can also apply to the lower members 18, 20. In this embodiment, the upper top clamp member 14 and upper bottom lower clamp member 16 are secured together on one end by a mechanism 42, attached to one of both members 14, 16, for flexibly and reversibly securing the two clamp members 14, 16 together. In this embodiment, the upper top clamp member 14 and upper bottom clamp member 16 are secured to each other by the hinge on one side of the members 14, 16. Likewise, the; set of lower clamp members 18, 20 are also secured to each other on one side by a reversible clamp member securing apparatus 42, in this embodiment a hinge.

The bottom member 16 can be laid flat and the upper top member 14 swung, using the hinge, until the two members are together. In this figure, the reversible clamp member securing mechanism 42 is shown in a pre-attached configuration.

Figure 5A:
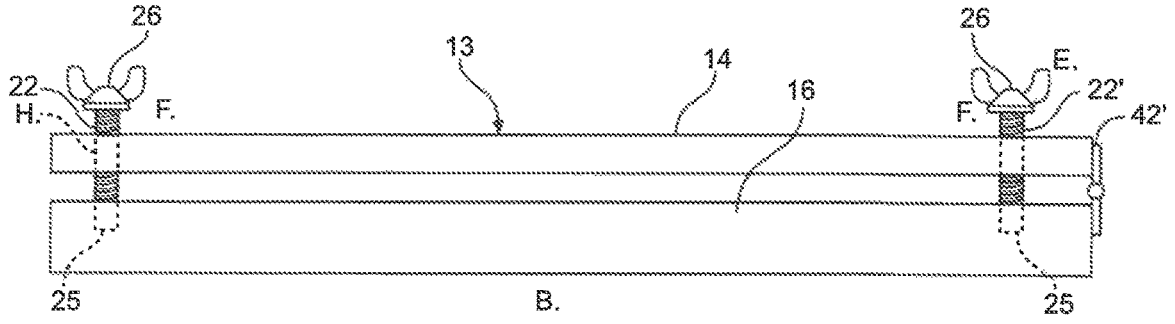
FIG. 5A is a side view of the portion of the invention of FIG. 5.

Turning to FIG. 5*a*, the top and bottom clamp members 14, 16 are shown brought together by the hinge 42 and fastened by the member holding mechanisms 22, 22'. The reversible clamp member securing mechanism 42 is attached to both members 14, 16. The members 14, 16 are placed together, then pressed together by at least one Member holding mechanisms 22, 22'. The at least one member holding mechanism 22, 22' can be comprised of two or more mechanisms, and in this embodiment is comprised of a pair of holding mechanisms 22, 22'. The Member holding mechanisms 22, 22' are provided to reversibly press the top and bottom clamp members 14, 16 to each other. In another embodiment, a single member holding mechanism 22 can be placed opposite the side of the hinge 42.

The member holding mechanisms 22 can be comprised of any suitable apparatus in the art capable of conveniently securing and releasing the clamp members 14, 16 to each other, including a screw and wing nut arrangement, a screw with turnable handle, or hydraulic or electrical system. The member securing system in this embodiment is a screw 25 and wing nut arrangement. These are placed within appropriate securing member apertures 40, 40'. The screw 25, is set through both clamp members 14, 16 within the member apertures 40, 40'. The screw 25 protrudes from the top member 14 enough for a wing nut 26 to be placed on it and twisted. By this method, the clamp members are squeezed closer to each other via the turning of the wing nut.

At least one member holding mechanism is similarly provided for the lower member set 18, 20.

Turning briefly to FIG. 1, likewise the lower top and bottom clamp members 18, 20 can be held to each other with a reversible securing apparatus such as a hinge 42' and reversibly fastened to each other with Member holding mechanisms 22," 22'".

Figure 6:
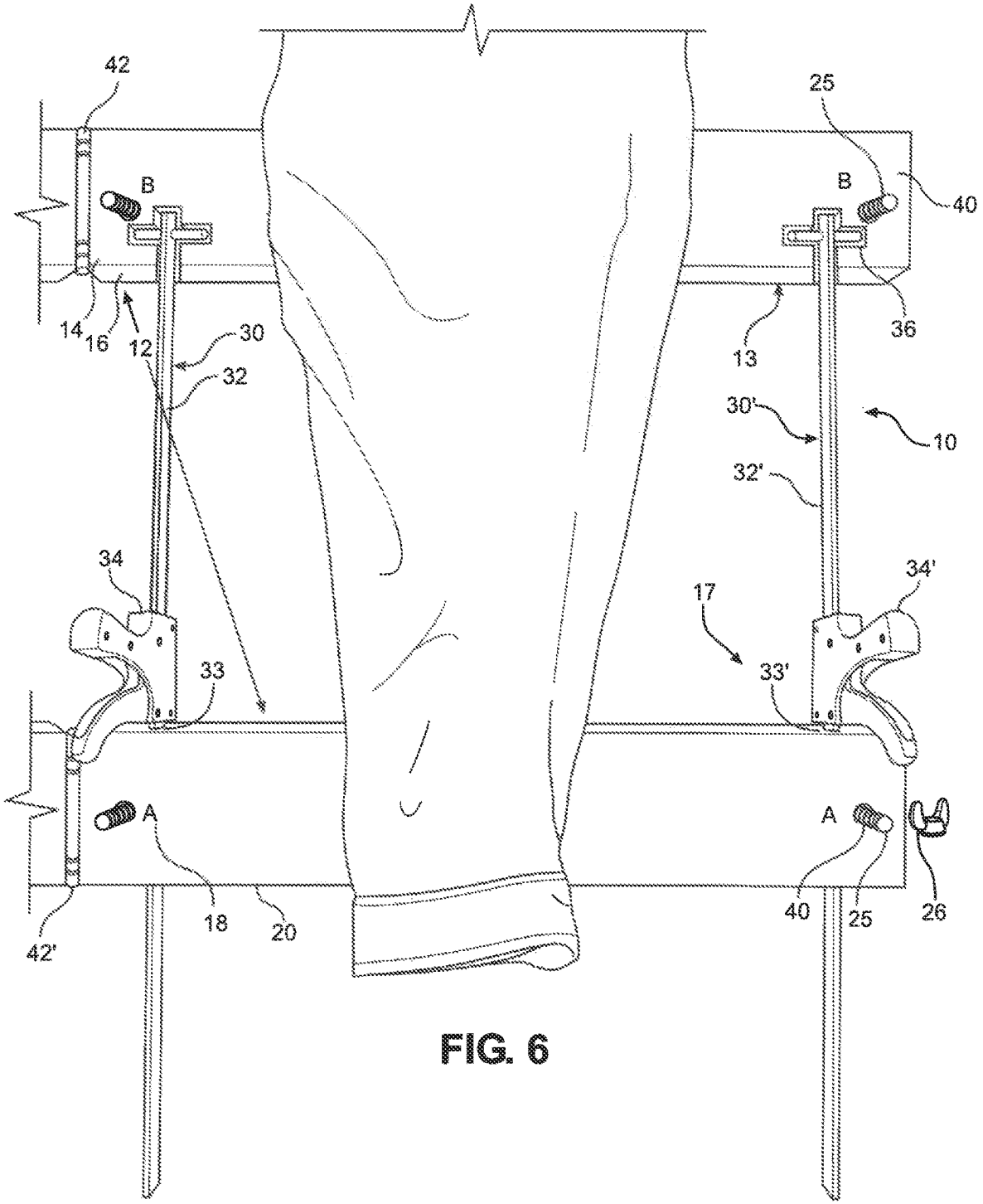
FIG. 6 is a top perspective view of an embodiment of the invention configured for use.
Figure 7:
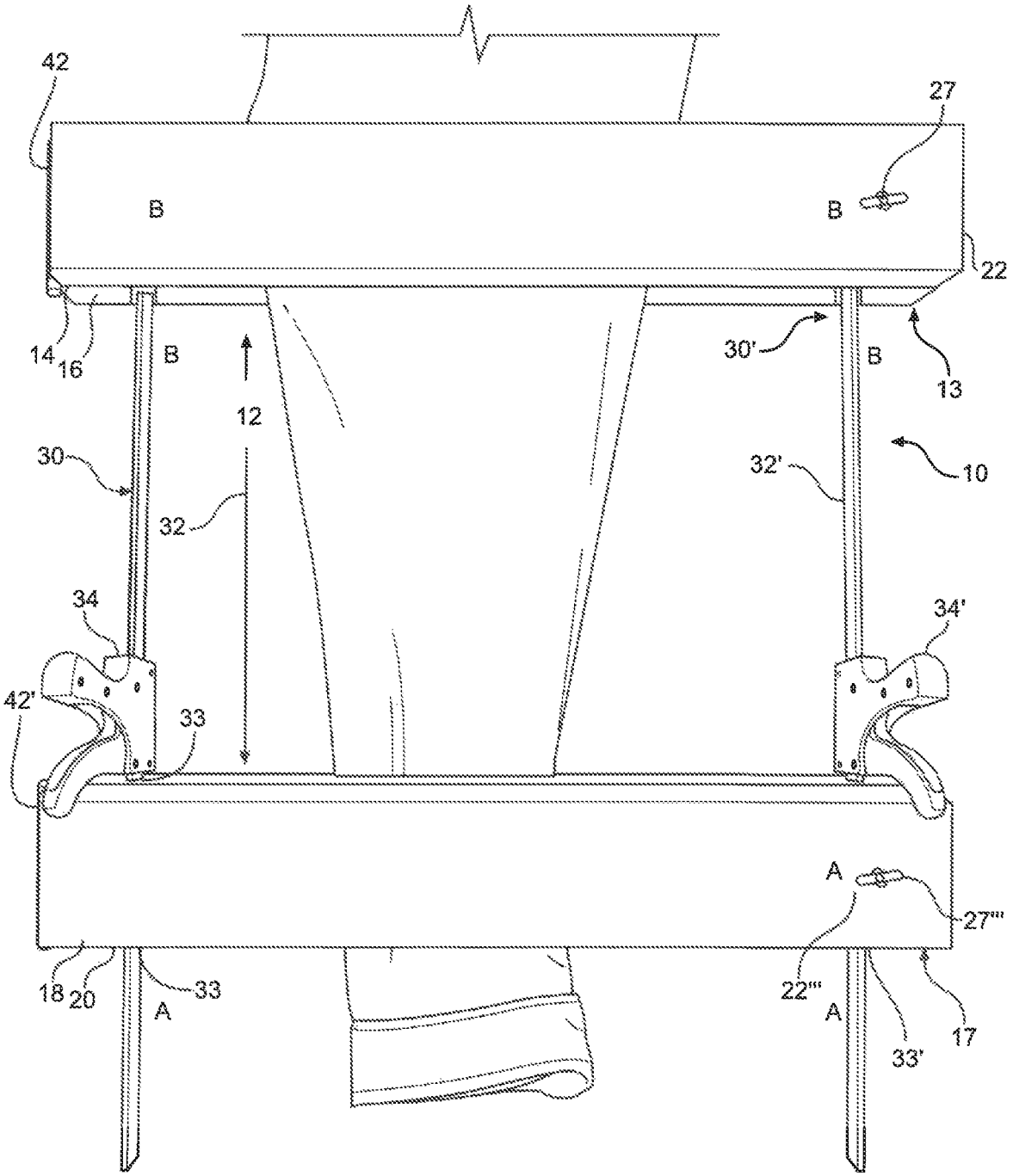
FIG. 7 is a top perspective view of an embodiment of the invention in use.
Figure 8:
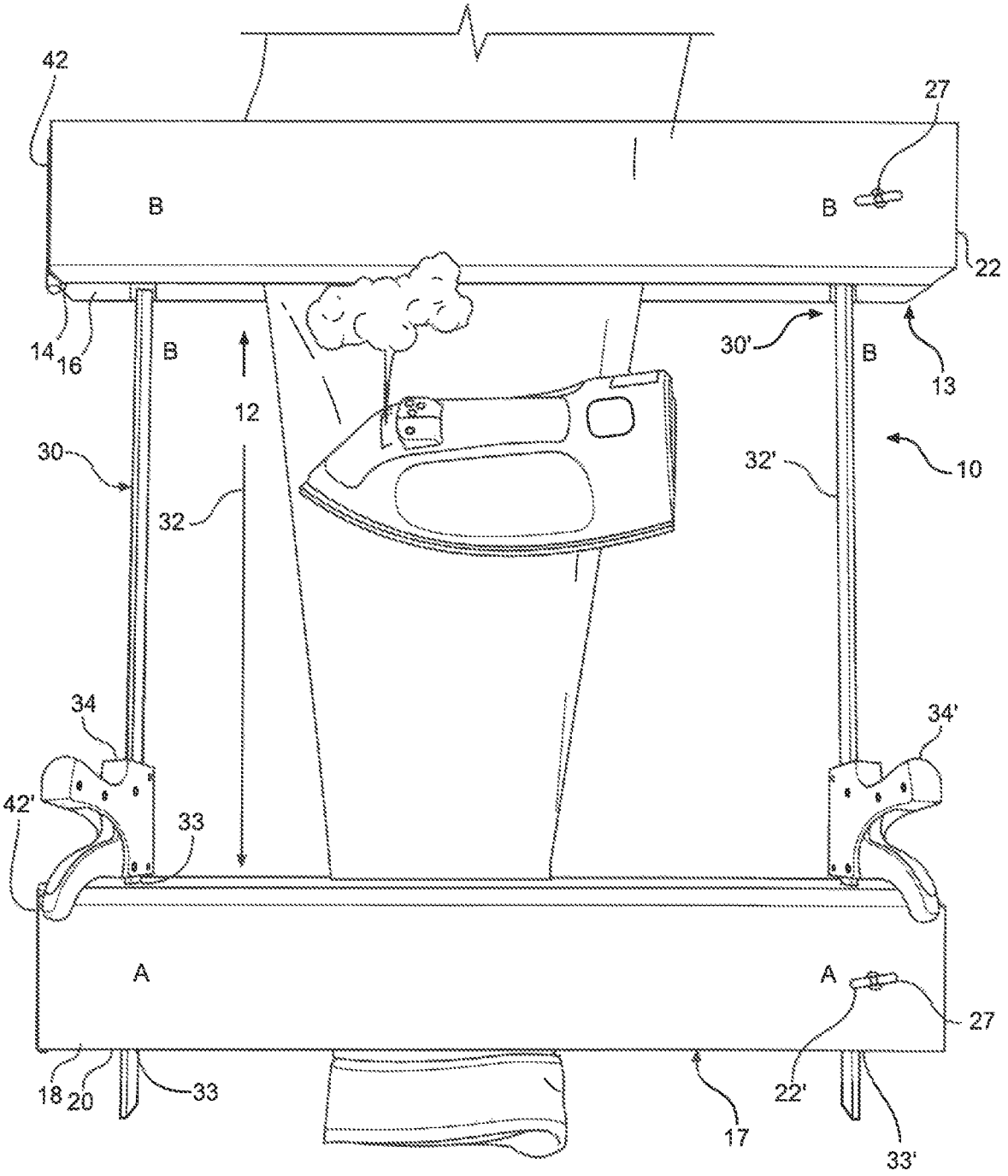
FIG. 8 is a top perspective view of an embodiment of the invention in use.

Turning to FIGS. 6-8, the system 10 will be shown in use.

Turning to FIG. 6, the device is shown assembled with an article of clothing 44 ready to be stretched. The article of clothing 44, in this case, a pair of pants, is provided and placed between the respective pairs of member sets 14, 16; 18, 20.

Turning to FIG. 7, the article 44 is placed on the respective bottom members 16, 20. If a reversible clamp member securing mechanisms 42, 42' are present, the respective upper and lower clamps 13, 17 are closed via the clamp securing mechanisms 42, 42'. Turning briefly to FIG. 4 and FIG. 1, each spreader upper securing mechanisms 36, 36' is placed within each respective upper member holding mechanism slots 24, 24'.

Respective rod slots 33, 33' are provided within one or more of the lower members 18, 20 (in this embodiment, the lower bottom clamp member 20). The lower end of each rod 30, 30' is placed and accommodated with each respective rod slot 33, 33'.

The upper and lower ends of the article of clothing 44 to be stretched are placed between the respective upper and lower clamps 13, 17. As a few examples; if the sleeve of a shirt is to be stretched, opposite ends of the sleeves are placed between the clamp member pairs 14, 16 and 18, 20. The same can be done with a pant leg. If the torso of a shirt is to be stretched, the whole shirt is placed within the clamp member pairs 14, 16 and 18, 20. When the article of clothing 44 is placed, the clamp member pairs 14, 16 and 18, 20. are closed together. As this happens, any member holding mechanisms, 22, 22' are aligned between each pair of members 14, 16 and 18, 20 and secured.

In this embodiment, each pair of members 14, 16 and 18, 20 has a clamp securing mechanism 42, 42' (A hinge in this embodiment) and a single member holding mechanism 22. Alternatively, each pair of members 14, 16 and 18, 20 can have (as shown in FIG. 3) no clamp securing mechanism 42, and instead multiple member holding mechanisms 22, 22'.

Turning briefly back to FIGS. 5 and 5*a*, securing member apertures 40, 40' are provided for the member holding mechanisms 22, 22' to be seated within.

Returning to FIG. 7, in this embodiment, each member holding mechanism 22 is comprised of a screw with rounded, turnable handle 27. The respective handles 27, 27' are tightened, resulting in the clamps 13, 17 tightening against each other, and the article of clothing 44 becoming more tightened and secured within the clamp members 14, 16 and 18, 20.

With everything tightened and secured, a user then activates the respective Spreader activation mechanisms 34, 34' (handles and trigger in this embodiment). As the triggers 34, 34' are squeezed, the spreaders 30, 30' move the article of clothing further and further apart. In this embodiment, the fabric is spread by way of mechanical spreading and contracting with the ratcheting advancing handles and triggers 34, 34'. For a few common examples, e.g., long sleeve shirt or blouse sleeves, shirt or blouse torso, and pants legs are common articles of clothing 44 that can be improved for use. The lower end of the article 44 is held in place as the upper end is stretched by the action of the spreaders 30, 30'. In this embodiment, the spreader triggers 34, 34' is operated by a trigger and ratcheting action. Over time, which may be hours or days, depending upon the article of clothing 44, the triggers 34, 34' can be activated over and over again, further stretching the article 44 to desired length.

In one example, a shirt sleeve is improved. A user needs a shirt with a longer sleeve. The shirt 44 is placed within the clamps 13, 17, at approximately the armpit at one end, and the end of the sleeve at the other. The member holding mechanisms 22, 22' are tightened until the shirt 44 is firmly in place. The spreader handle triggers 34, 34' are activated, creating a pulling action between the appropriate points of the shirt 44. The spreader handle triggers 34, 34' can be tightened again and again, as needed to stretch the sleeve of the shirt 44 to desired length The shirt sleeve can be left in the device 10 overnight if needed. A normal time for sufficient stretching is typically about 12 hours, but can be 24 hours, or for more length, may be about 48 hours. Pressure between the two handles 34, 34' should be about equal but does not have to be exact.

Turning to FIG. 8, added steps, such as ironing, steaming, or the addition of further items such as water, fabric softener, or starch can be used to enhance, smooth out, improve the stretching action, and improve the operation of the invention. Further, leaving the article 44 in the device 10 with weight added can enhance performance considerably.

Figure 9:
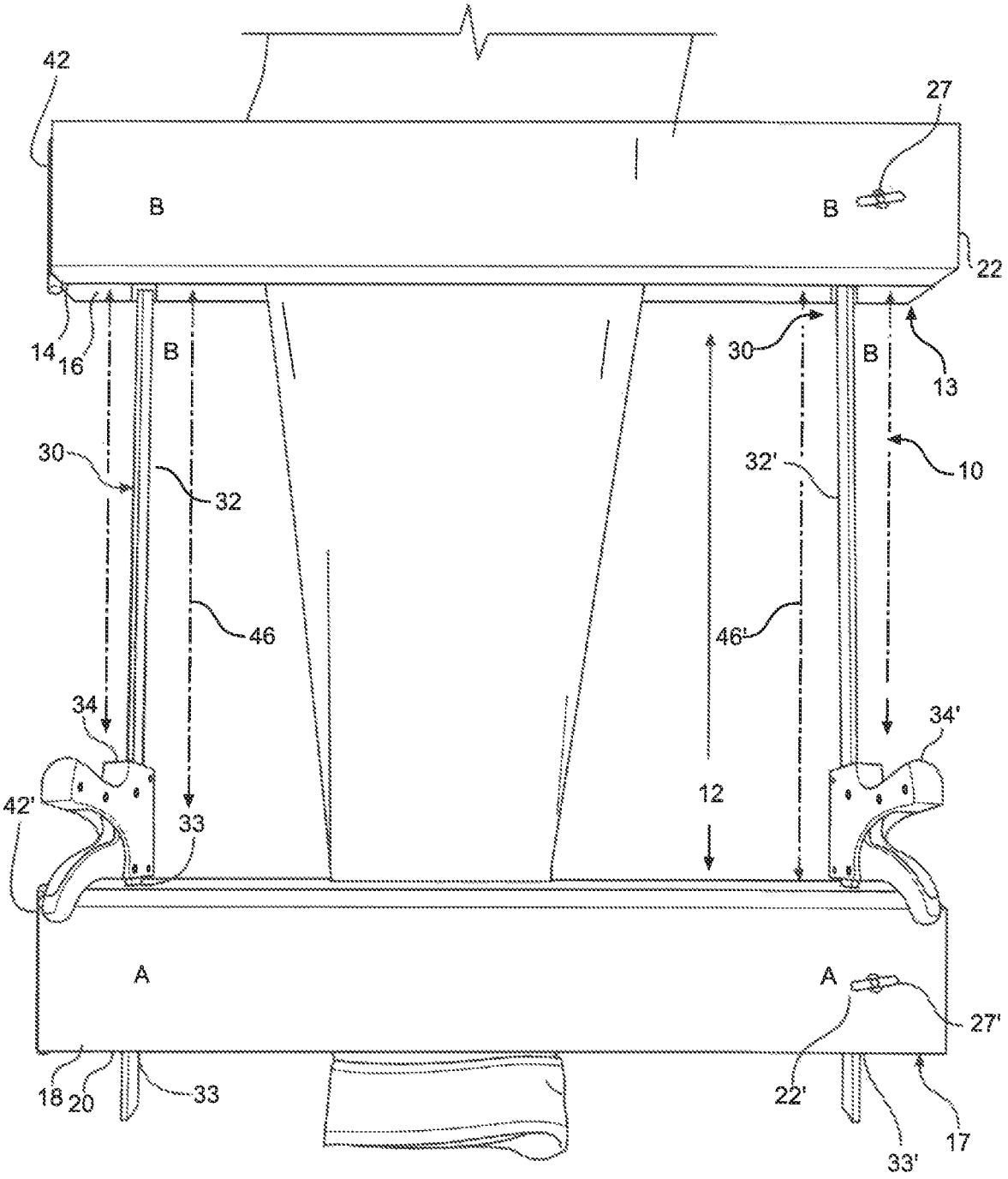
FIG. 9 is a top perspective view of an embodiment of the invention in use.

FIG. 9 an additional frame member, or frame members 46, 46' can be provided between the upper and lower member pairs 14, 16; 18, 20 can be added to make the device 10 a one-piece system. In another embodiment, frame members 46, 46' and either the top members 14, 18, or lower members 16, 20, can be a single piece design, with the remaining top or lower members secured to the single piece.

When the article 44 has been stretched to suitable length, the spreaders 30, 30' and the member holder mechanisms 22, 22' are loosened to make the top members 14, 18 removeable. Any parts of the member holder mechanisms 22, 22', such as, e.g., wing nuts 26, 26' or turnable handles 27, 27' that need to be removed are. Any Reversible clamp member securing mechanisms 42, 42' such as hinges are swung or otherwise activated. By these means, the upper members 14, 18 are loosened and the article of clothing 44 can then be removed from between the pairs of members 14, 16 and 18, 20.

Figure 10:
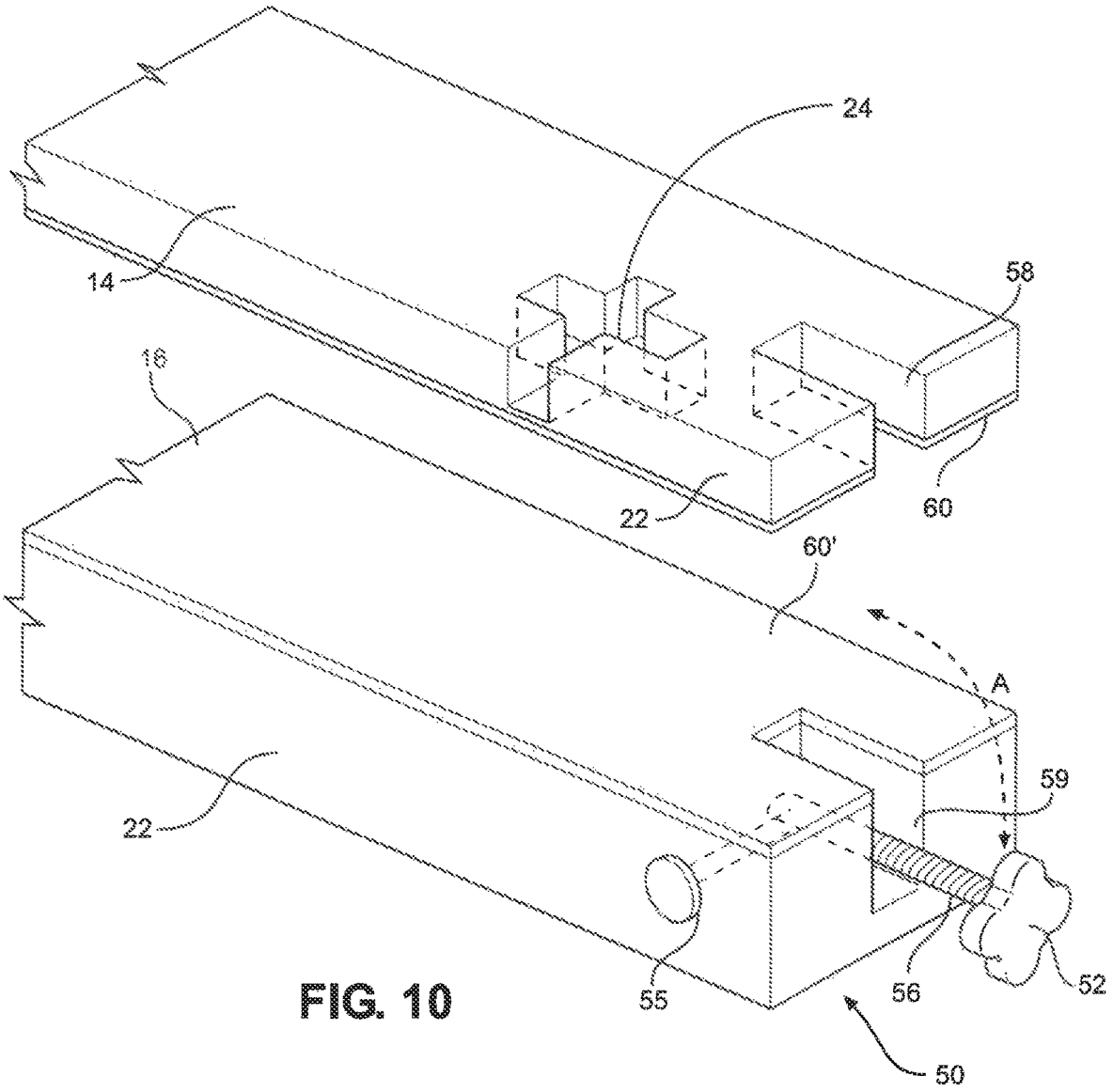
FIG. 10 is a perspective view of an embodiment of the invention.
Figure 11:
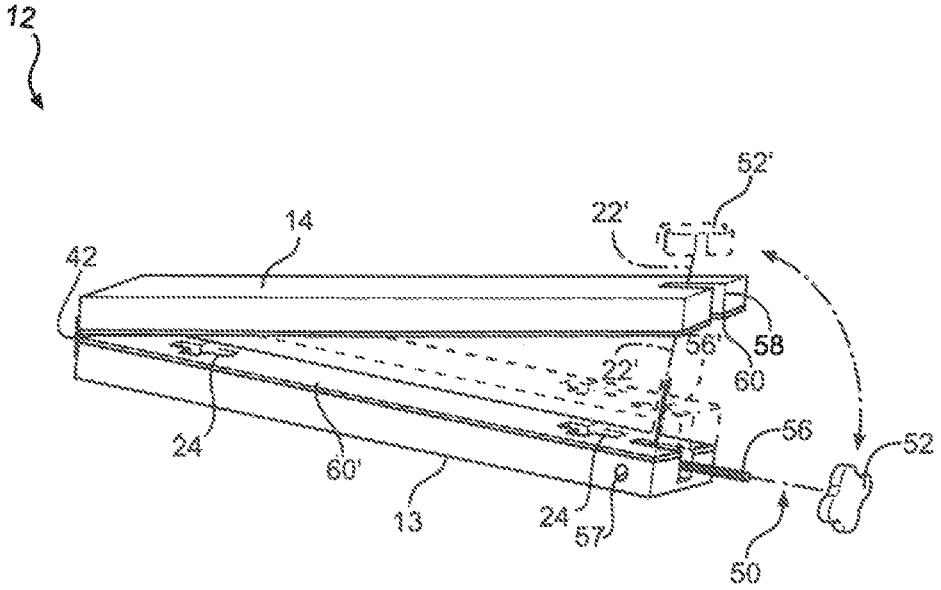
FIG. 11 is a perspective view of an embodiment of the invention.
Figure 11A:
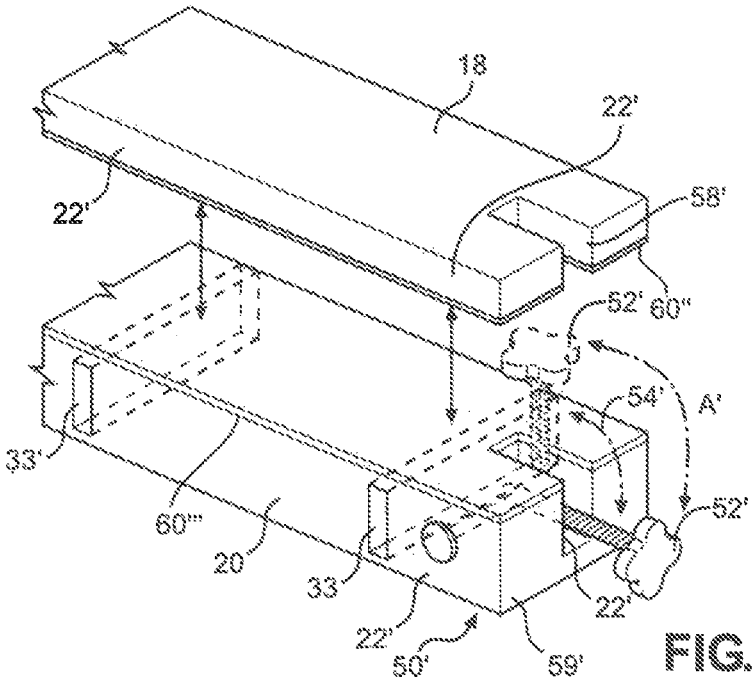
FIG. 11A is a perspective view of an embodiment of the invention.

Turning generally to FIGS. 10-11A, in some embodiments, each member holding mechanism 22, 22' can be comprised of a respective swing bolt assembly 50, 50'. Turning specifically to FIGS. 10 and 11A, as indicated by the arrows A, A', each respective swing bolt assembly 50, 50' is designed to be capable of swinging from roughly parallel to one respective member 16, 20 upward in an approximately 90 degree motion to roughly perpendicular to the respective top and bottom members 14, 16, 18, with member holding mechanisms 22, 22' roughly above the top members 14, 18.

Turning to FIG. 11, the member holding mechanisms 22, 22' similar to previous embodiments, can be comprised of a hinge 42, 42' on one end of each clamp 13, 17, and swing bolt assembly 50, 50' on the other side of the respective clamps 13, 17. Or they can be comprised of, for example, a pair of swing bolt assemblies 50, 50' on each respective clamp 13, 17. The hinges 42, 42' can further be configured as suitable. The hinges 42, 42' can be placed on the outside of the member pairs 14, 16 and 18, 20, as shown previously, or as in this embodiment, each respective hinge 42, 42' can be placed on the respective top surfaces of the members, and close upon itself.

Turning generally to FIGS. 10-11*a*, each respective swing b it assembly 50, 50' can be comprised of any suitable apparatus in the art for the purpose of providing a swinging action to a bolt with a securing mechanism 52 (such as here a turning handle) for tightening each respective clamp 13, 17.

Turning to FIGS. 11-11A, in an embodiment, the swing bolt assembly 50, is comprised of a single or multi-piece T-shaped bolt 54 and accompanying securing apparatus (in this embodiment, a handle) 52. Turning to FIG. 10, in another embodiment, the swing bolt assembly 50 can, for another example, be comprised of an assembly comprising an anchor 55 within a member 16 with an extending bolt 56, with handle 52. Turning to FIG. 11A, each swing bolt assembly 50, 50' can be comprised of a dowell 57, 57' provided within each member 16, 20 attached to an extending bolt 56, 56'. Each dowell 57, 57' can be comprised of any suitable material in the art such as, e.g., a plastic or other resin, wood, or a metal, and be attached to the bolt 56 by any suitable means known in the art.

Turning to FIGS. 10-11A, at least a pair of appropriately shaped swing bolt slots, an upper swing bolt slot 58, 58', and lower swing bolt slot 59', 59' are provided within each member 14, 16, 18, 20 to accommodate the swing bolt assembly 50 for each clamp. FIG. 11 shows the swing bolt assemblies 50, 50' on both clamps 13, 17, while FIGS. 10 and 11A show each of the swing bolt assemblies 50, 50' in further detail.

Turning to FIGS. 10-11A, it is of note that in some embodiments, as herein, each member 14. 16. 18. 20 of the clamps 13, 17 has an added surface support layer 60. 60'. 60". 60'" to protect the article 44. The added surface support layer 60, 60', 60", 60'" can be comprised of any material known in the art non-rigid enough to not damage the article of clothing 44, but firm enough, and providing sufficient friction, to hold the article 44 as it is stretched. These materials can include, for example, rubber, rubberized material, or plastic or other resin.

Turning to FIG. 11, as an example of use, an article of clothing 44 can be placed on top of the respective bottom members 16, 20, on the bottom surface support layer 60', 60". The respective top members 14, 18 are swung downward with the hinges 42, 42' onto the respective bottom embers 16, 20. As indicated most specifically by the arrows A and A' in FIGS. 10 and 11*a*, and the position change of the swing bolt assemblies 50 in FIG. 11, the respective swing bolt assemblies 50, 50' are swung upwards.

Turning to FIG. 11, when the swing bolt assemblies 50, 50' are swung into position, the respective handles 52. 52' typically above the upper members 14, 18, are tightened, thereby tightening the article of clothing 44 between the respective top and bottom surface support layer 60, 60' and 60", 60'" and/or respective member pairs 14, 16 and 18, 20. From here, the steps for stretching the article 44 cam be completed as already shown herein.

As arms and legs grow, the ability to stretch clothing can help clothing keep up with this growth, so that clothing does not need to be discarded. With this invention, struggles to find off the shelf clothing that fits, or to retain children's clothes longer, can be satisfied. Children's clothing life can extend through an entire school year by not having to buy school clothing bought in the fall only to have to replace it in the spring. Further, clothing life can be extended generally. This ability to preserve clothing can expand the clothing that can be bought, and save users, particularly parents, hundreds or even thousands of dollars each year. This also provides a user an increased variety of clothing they can buy, removing, for example, shirts that are limited by having too short sleeves. In addition, longer sleeves can provide more room for a user's elbows within a shirt.

It is to be understood that while certain forms of the present invention have been illustrated and described herein, the expression of these individual embodiments is for illustrative purposes and should not be seen as a limitation upon the scope of the invention. It is to be further understood that the invention is not to be limited to the specific forms or arrangements of parts described and shown.

The invention claimed is:

1. A fabric stretching system, comprised of:
a set of clamps,
wherein the set of clamps is comprised of an upper clamp and a lower clamp,
and wherein the upper clamp is further comprised of an upper top clamp member and an and an upper bottom clamp member,
and wherein the lower clamp is further comprised of a lower top clamp member and a lower bottom clamp member;
at least one clamp, member holding mechanism configured to reversibly secure each respective top and bottom clamp member to each other;
and at least a pair of fabric stretching spreading mechanisms,
wherein each respective fabric spreading mechanism is comprised of:
at least one spreader rod,
and at least one respective spreader activation mechanism, comprised of a ratcheting mechanism and configured to work with the at least one spreader rod.

2. A fabric stretching system according to claim 1,
wherein each respective member holding mechanism is configured to reversibly tighten at least one of the respective pairs of top and bottom clamp members, and is comprised of:
at least one ratchet,
at least one lever,
at least one hydraulic or electrical system,
or at least one screw and nut,
or at least one screw with a turnable handle,
or a combination of these.

3. A fabric stretching system according to claim 1,
wherein the system is comprised of at least one clamp member holding mechanism configured to secure each respective spreader rod at at least one end within at least one clamp member.

4. A fabric stretching system according to claim 3,
wherein each clamp member holding mechanism is comprised of:
at least one member slot within at least one member of at least one clamp,
and at least one respective spreader securing mechanism at one end of each respective spreader rod configured to be secured within each respective member slot.

5. A fabric stretching system according to claim 4,
wherein the each spreader securing mechanisms is comprised of:
a hook-shaped protrusions attached to and perpendicular from each respective spreader rod, or a spring device attached to each respective spreader rod, or a member situated perpendicular from and attached to each respective spreader rod.

6. A fabric stretching system according to claim 1, wherein the system is further comprised of at least one spreader rod slot located within at least one clamp member, and wherein each spreader rod slot is configured to fit an end of each respective spreader rod.

7. A fabric stretching system according to claim 1, wherein the at least one spreader activation mechanism is comprised of a handle and trigger ratcheting mechanism.

8. A fabric stretching system according to claim 1, wherein each respective spreader activation mechanism is comprised of a ratcheting mechanism, which is comprised of:

a handle and trigger ratcheting mechanism, at least one turnable handle, a push button or switch or signal apparatus attached to a motor, a hydraulic apparatus, an electric motor with controls, or a combination of these.

9. A fabric stretching system according to claim 1, wherein the spreader activation mechanisms is comprised of:

at least a pair of tightening trigger mechanisms, and at least a pair of respective spreader securing mechanisms provided at or near the end of each respective spreader rod, wherein each securing mechanism is comprised of:

at least one screw attached to each respective spreader rod by at least one nut, at least one screw attached directly to each respective spreader rod, at least one securing rod either attached to each respective spreader rod, or joined with each respective spreader rod as a one-piece construction, or a combination of these, and at least one respective clamp member slot or aperture placed within a respective clamp member configured to accommodate each securing mechanism.

10. A fabric stretching system according to claim 1, wherein the system is further comprised of:

at least one reversible member securing mechanism configured to reversibly secure a top and bottom clamp member to each other, and is attached to a respective pair of top and bottom clamp members, and at least one member holding mechanism.

11. A fabric stretching system according to claim 10, wherein the reversible member securing mechanism is comprised of a hinge, and the member holding mechanism is comprised of:

at least one nut and screw, at least one screw and wing nut a screw with turnable handle, a screw with a hydraulic or electrical powering system, or a combination of these.

12. A fabric stretching system according to claim 1, wherein the system is further comprised of at least one respective spreader rod slot configured to accommodate each spreader rod within at least one set of clamp members.

13. A fabric stretching system according to claim 1, wherein each pair of clamp members is further comprised of:

a clamp securing mechanism, and a single member holding mechanism, and wherein the system is further comprised of a securing member aperture configured to seat each respective member holding mechanisms.

14. A fabric stretching system according to claim 1, wherein each respective clamp is further comprised of:

at least one member holding mechanisms, wherein each member holding mechanism is comprised of a screw with rounded, turnable handle configured to tighten a pair of claim members against each other, and a securing member aperture configured to seat each respective member holding mechanism.

15. A fabric stretching system according to claim 1, wherein at least one clamp is further comprised of:

a respective swing bolt assembly comprised of:

an anchor or dowell, a bolt attached to the anchor or dowell, and securing apparatus attached to the bolt, and an upper swing bolt slot and lower swing bolt slot within each respective member of the clamp configured to accommodate the swing bolt assembly.

16. A method of providing a fabric stretching system, comprised of the steps of:

providing a set of clamps, wherein the set of clamps is comprised of an upper clamp and a lower clamp, and wherein the upper clamp is further comprised of;

an upper top clamp member and an and an upper bottom clamp member and wherein the lower clamp is comprised of;

a lower top clamp member and a lower bottom clamp member and providing at least a pair of respective clamp, member holding mechanisms configured to reversibly secure each respective top and bottom clamp member to each other, and providing at least a pair of fabric spreading mechanisms, wherein each respective fabric spreading mechanism is comprised of:

at least one spreader rod, and at least one spreader activation mechanism, comprised of a ratcheting mechanism, and wherein each fabric spreader activation mechanism is connected to, and configured to work with, the at least one spreader rod.

17. A method of providing a fabric stretching system according to claim 16, wherein the at least one spreader activation mechanism is comprised of a handle and trigger ratcheting mechanism.

18. A method of providing a fabric stretching system according to claim 16, wherein the spreader activation mechanisms is comprised of:

at least a pair of tightening trigger mechanisms, at least one respective spreader securing mechanism provided at or near the end of each respective spreader rod, wherein each securing mechanism is comprised of:

at least one screw attached to each respective spreader rod by at least one nut, at least one screw attached directly to each respective spreader rod, at least one securing rod either attached to each respective spreader rod, or joined with each respective spreader rod as a one-piece construction, or a combination of these, and providing at least one respective clamp member slot or aperture placed within a respective clamp member configured to accommodate each securing mechanism.

19. A method of providing a fabric stretching system according to claim 16 wherein each pair of clamps is further comprised of:

a clamp securing mechanism, and a single member holding mechanism, and a securing member aperture configured to seat each respective member holding mechanism.

* * * * *